US009295108B2

(12) United States Patent
Bohlender et al.

(10) Patent No.: US 9,295,108 B2
(45) Date of Patent: Mar. 22, 2016

(54) ELECTRICAL HEATING DEVICE AND METHOD FOR THE PRODUCTION THEREOF

(75) Inventors: Franz Bohlender, Kandel (DE); Michael Niederer, Kapellen Drusweiler (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 499 days.

(21) Appl. No.: 13/610,966

(22) Filed: Sep. 12, 2012

(65) Prior Publication Data

US 2013/0000108 A1 Jan. 3, 2013

Related U.S. Application Data

(62) Division of application No. 13/251,470, filed on Oct. 3, 2011, now abandoned.

(30) Foreign Application Priority Data

Oct. 8, 2010 (EP) ..... 10013474

(51) Int. Cl.
*A47J 31/00* (2006.01)
*H05B 3/00* (2006.01)
(Continued)

(52) U.S. Cl.
CPC ..... *H05B 3/24* (2013.01); *F24H 1/009* (2013.01); *F24H 9/0015* (2013.01); *F24H 9/1827* (2013.01); *F24H 9/2028* (2013.01); *H05B 2203/02* (2013.01); *Y10T 29/49083* (2015.01)

(58) Field of Classification Search
CPC ..... H05B 2203/02; H05B 3/24
USPC ..... 29/611, 592, 613, 615, 622, 623.2, 825, 29/829–834, 841, 855; 392/465, 466, 392/311–314, 340–341, 378
See application file for complete search history.

(56) References Cited

U.S. PATENT DOCUMENTS 4,157,466 A * 6/1979 Herrin ..... 219/210
5,812,375 A 9/1998 Casperson
(Continued)

FOREIGN PATENT DOCUMENTS

DE 10034572 A1 1/2002
DE 102008003787 A1 7/2009
(Continued)

OTHER PUBLICATIONS

European Search Report Dated Mar. 8, 2011 for European Patent Application Serial No. EP 10 01 3474.

*Primary Examiner* — Dana Ross
*Assistant Examiner* — Ket D Dang
(74) *Attorney, Agent, or Firm* — Boyle Fredrickson, S.C.

(57) ABSTRACT

A method of assembling an electrical heating device is provided. The electrical heating device includes a housing which encloses a circulation chamber through which a medium can flow and in which heating ribs protrude. The heating ribs are in thermally conducting contact with at least one PTC heating element. A control device is provided in a constructional unit with at least one assembled conductor board. The constructional unit is accommodated in a control housing that comprises a control housing cover and a control housing frame. The control housing frame circumferentially surrounds the assembled conductor board and is formed from a metallic material. The method includes installing the control housing on the housing such that a control element, producing a power loss, is held by the assembled conductor board and is placed in abutment with a cooling element formed on the housing.

14 Claims, 15 Drawing Sheets

(51) Int. Cl.

| | |
|---|---|
| ***H05B 3/24*** | (2006.01) |
| ***F24H 1/00*** | (2006.01) |
| ***F24H 9/00*** | (2006.01) |
| ***F24H 9/18*** | (2006.01) |
| ***F24H 9/20*** | (2006.01) |

(56) References Cited

U.S. PATENT DOCUMENTS

| | | | | |
|---|---|---|---|---|
| 6,185,100 | B1 * | 2/2001 | Bentz et al. | 361/704 |
| 6,189,482 | B1 * | 2/2001 | Zhao et al. | 118/723 R |
| 2002/0011484 | A1 * | 1/2002 | Beetz et al. | 219/530 |
| 2004/0084431 | A1 * | 5/2004 | Uhl et al. | 219/201 |
| 2008/0000889 | A1 * | 1/2008 | Niederer et al. | 219/205 |
| 2008/0099464 | A1 * | 5/2008 | Niederer et al. | 219/520 |
| 2008/0128401 | A1 * | 6/2008 | Bohlender et al. | 219/202 |
| 2009/0020515 | A1 * | 1/2009 | Clade et al. | 219/202 |

FOREIGN PATENT DOCUMENTS

| | | | |
|---|---|---|---|
| EP | 1 157 867 | A1 | 11/2001 |
| EP | 1 395 098 | A1 | 3/2004 |
| EP | 1 630 013 | A1 | 3/2006 |
| EP | 1 872 986 | A1 | 1/2008 |
| WO | 2009/021777 | A2 | 2/2009 |

* cited by examiner

ELECTRICAL HEATING DEVICE AND METHOD FOR THE PRODUCTION THEREOF

CROSS REFERENCE TO RELATED APPLICATION

This application is a divisional of co-pending and commonly assigned U.S. patent application Ser. No. 13/251,470, filed Oct. 3, 2011, entitled "Electrical Heating Device and Method for the Production Thereof", the contents of which are hereby incorporated by reference in its entirety.

BACKGROUND OF THE INVENTION

1. Field of the Invention

The present invention relates to an electrical heating device, in particular for a motor vehicle, with a housing, which encloses a circulation chamber through which a medium can flow, in which heating ribs protrude, which are in thermally conducting contact with at least one PTC heating element, and with a control device provided in a constructional unit with at least one assembled conductor board, which is accommodated in a control housing.

2. Description of the Related Art

An electrical heating device of this nature is known from EP 1 872 986 A1 which originates from the applicant. This prior-art electrical heating device involves a type with a housing, which encloses a circulation chamber through which a medium can flow. In this respect the heating ribs protrude enveloped by heating ribs with in each case a U-shaped recess in the circulation chamber. The U-shaped recesses are provided within the housing and separate the circulation chamber, through which the fluid to be heated can flow, from a connecting chamber in which the power current is passed for the electrical supply of the PTC heating elements.

However, the present invention is not restricted to electrical heating devices of this nature normally designed for liquid media. Also an electrical heating device for heating air, in particular for heating the interior of a motor vehicle, can be regarded as generic. With this device the heating ribs are normally formed by meander-type bent sheet metal strips, which are exposed to the air flow to be heated and directly abut the PTC heating elements. These PTC heating elements comprise at least one PTC block and on oppositely situated sides of them abutting sheet metal bands, through which the PTC blocks can be supplied with electrical current with different polarity. The housing is normally formed by a frame, frequently of plastic. This frame has a very slight extension in the flow direction of the air to be heated. A generic electrical heating device of this nature with a control device in a constructional unit is for example known from EP 0 901 311 or DE 199 25 757.

Electrical heating devices of this nature switch high currents. With the usual on-board electrical voltage of 12 volts currents of over 250 amps and with high-voltage applications of 180 to 500 volts currents of over 70 amps are switched in order to obtain the required heating powers. This demands amongst other aspects special contacting of all elements of the electrical heating devices. A good contact resistance must always be ensured on all live connections. Furthermore, with electrical heating devices of this nature there is the problem that switching high currents leads to electromagnetic interference, which admittedly can be reduced with electrical heating devices with a control device in a constructional unit, but not completely eliminated. Thus, EMC problems continue to present an obstacle to a satisfactory electrical heating device producing high thermal outputs.

SUMMARY OF THE INVENTION

The object of the invention is to provide an electrical heating device of the type mentioned in the introduction, which takes into account the EMC problems in an improved manner and can be economically manufactured. Furthermore, the intention of the present invention is to specify an electrical heating device of the type mentioned in the introduction with a control device with an assembled conductor board, which at least bears one control element producing a power loss, with a method by which the electrical control device can be manufactured particularly easily.

For the solution of the device-related problem the invention suggests an electrical heating device that differs from the generic state of the art in that the control housing comprises a control housing frame and a housing cover, which abuts a face side of the control housing frame. The control housing frame circumferentially surrounds the assembled conductor board and is formed from a metallic material. In a similar way the control housing cover is also preferably formed from a metallic material. In this way in any case a control housing is provided surrounding the assembled conductor board and thus screening the components on the laminated conductor board to the outside. The control housing frame is here preferably formed as a cylindrical component, i.e. it has—apart from face-side boundary surfaces, in particular on the ends of the control housing frame—only walls the surfaces of which extend parallel to one another. Here the control housing frame is formed in aluminium. The housing cover can however be formed from another material, for example from punched steel sheet.

The control housing frame can be realised as one part with a supporting framework structure which is provided for the positioning and/or fixing of the assembled conductor board. The supporting framework structure is here preferably provided as a lattice structure with relatively thin walls such within the control housing frame that most of the interior space of the control housing frame remains free from the supporting framework structure.

Taking into account the manufacture of the control housing frame in the course of extrusion, functional surfaces and elements provided as one part on the control housing frame preferably extend between the two face sides of the control housing frame, preferably with the same amount of longitudinal extension which the walls of the control housing frame have. According to a preferred further development of the present invention the supporting framework structure is however manufactured as a separate component and is joined to the control housing frame. For this purpose, it can for example have longitudinal grooves, which are formed on inner wall sections of the control housing and in which hammer-head ends of the supporting framework structure are introduced to retain them at a predetermined position. The supporting framework structure is in this case located preferably with its upper side flush with that free face side of the control housing frame on which the control housing cover abuts. Thus, the control housing cover screwed onto the control housing frame forms an end-stop for the separate element forming the supporting framework structure.

In the inventive electrical heating device, the supporting framework structure bears a compressible compression element which produces compression force acting against the assembled conductor board. The supporting framework structure is then fixed under compression between the assembled conductor board and the control housing cover. The aspect of clamping the assembled conductor board by an element storing elastic strain components, such as for example a compression element, may in itself be inventive. With an embodiment of this nature, additionally at least a means is provided with which the conductor board is pressed against the housing which encloses a circulation chamber through which the medium to be heated flows, or however against a heat sink, which is arranged in this housing such that it is in thermally conducting contact with the medium to be heated. The compression element can be formed separately or as one part with the supporting framework structure. Also the supporting framework structure can overall form the compression element. It is also conceivable to manufacture the compression element in the course of two-component injection moulding, whereby a compressible more flexible plastic is formed in the vicinity of the assembled conductor board, whereas a harder and stiffer plastic is located in the vicinity of the control housing cover.

The compression element is preferably formed from a plastic with Shore A hardness between 60 and 80. In particular silicone (Si) or a rubber (EPDM) can be considered as a suitable material.

The compression element is used for fixing the conductor board against an opposing surface formed on the underside on the housing of the heating device and/or on a housing base. Due to this compressive force the assembled conductor board is then fixed in the height direction of the control housing frame, and in a plane extending transversely to the direction of action of the compression force the assembled conductor board is normally accommodated with slight play between the inner surfaces of the control housing frame and accordingly positioned.

The transfer of the compression force from the compression element to the assembled conductor board preferably occurs through pillar supports which extend at right angles to the surface of the assembled conductor board. These pillar supports can just rest on the surface of the assembled conductor board situated opposite the supporting framework structure, they can penetrate the conductor board or however protrude over the conductor board and for example be formed thickened by fusion of the free ends of the pillar supports in order to join the conductor board captively to the supporting framework structure. Normally, a plurality of pillar supports are provided, each of which can be formed deviating from one another subject to the above. Generally however, it is sufficient just to abut the pillar supports against the surface of the assembled conductor board facing the supporting framework structure in order to press the assembled conductor board with pressure against the above mentioned opposing surface and then to fix it.

The compression force caused by the compression element is preferably used to dissipate heat of one or all control elements, which produce a power loss and which are borne by the conductor board, to a cooling element. For this purpose the control element producing the power loss is located on the side of the conductor board facing away from the compression element, and namely preferably between the free end of the pillar support and the cooling element. The pillar support can here directly abut the control element producing the power loss or however with the intermediate positioning of a further element, in particular the assembled conductor board.

In particular with the formation of the housing in plastic it is preferable to form the cooling element as separate therefrom in a good thermally conducting material, such as for example aluminium or copper and to provide a heat conducting contact with the medium to be heated. Here, the cooling element can be directly exposed in the circulation chamber or however in a region of the electrical heating device separate therefrom and subject to the flow of the medium to be heated. The cooling element can however be formed just as well by a region of the housing, in particular when the housing itself is formed from a good thermally conducting material.

With a view to the best possible thermal conduction, according to a preferred further development of the present invention it is suggested that a control housing base is provided which abuts a face side of the control housing frame which is other than the control housing cover and which at least has one opening in extension of the pillar support. In this way the possibility is obtained of thermally conductively joining the control element producing the power loss to a cooling element which is located outside of the control housing, in particular within the housing of the heating device and which then can also be designated as the heater housing.

Due to an electrically insulating layer between the element producing the power loss and the cooling element, in particular located in the heater housing, the possibility is obtained of isolating the control device electrically from the heater housing which encloses the circulation chamber.

On the other hand, considering an easy manufacture and secure fastening of the control housing to the heater housing, the control housing frame has mounting protrusions in the corner areas. These protrusions are preferably formed as a type of eye, through which a threaded rod can be passed so that the threaded rod is held positively locked within the eye. A threaded rod of this nature, which for example can be formed by the shank of a screw, is held in the corresponding mounting protrusions on the control housing frame and is preferably screwed to the housing forming the circulation chamber. Here the cooling element(s) and the face side of the control housing frame which can abut the heater housing and the control element(s) producing the power loss are matched such that with this screwing of the control housing frame onto the heater housing initially a contact is produced between the cooling element and the control element producing the power loss. With increasing screwing a prestressed contact of the control element producing the power loss occurs on the surface of the cooling element until finally, after termination of the assembly, the face side of the control housing contacts the housing and the control element producing the power loss is assembled under contact pressure directly or indirectly—in any case however thermally conducting—against the surface of the cooling element.

BRIEF DESCRIPTION OF THE DRAWINGS

Further details and advantages of the present invention are given in the following description of an embodiment in conjunction with the drawing. This shows the following.

DETAILED DESCRIPTION OF THE PREFERRED EMBODIMENT

Figure 1:
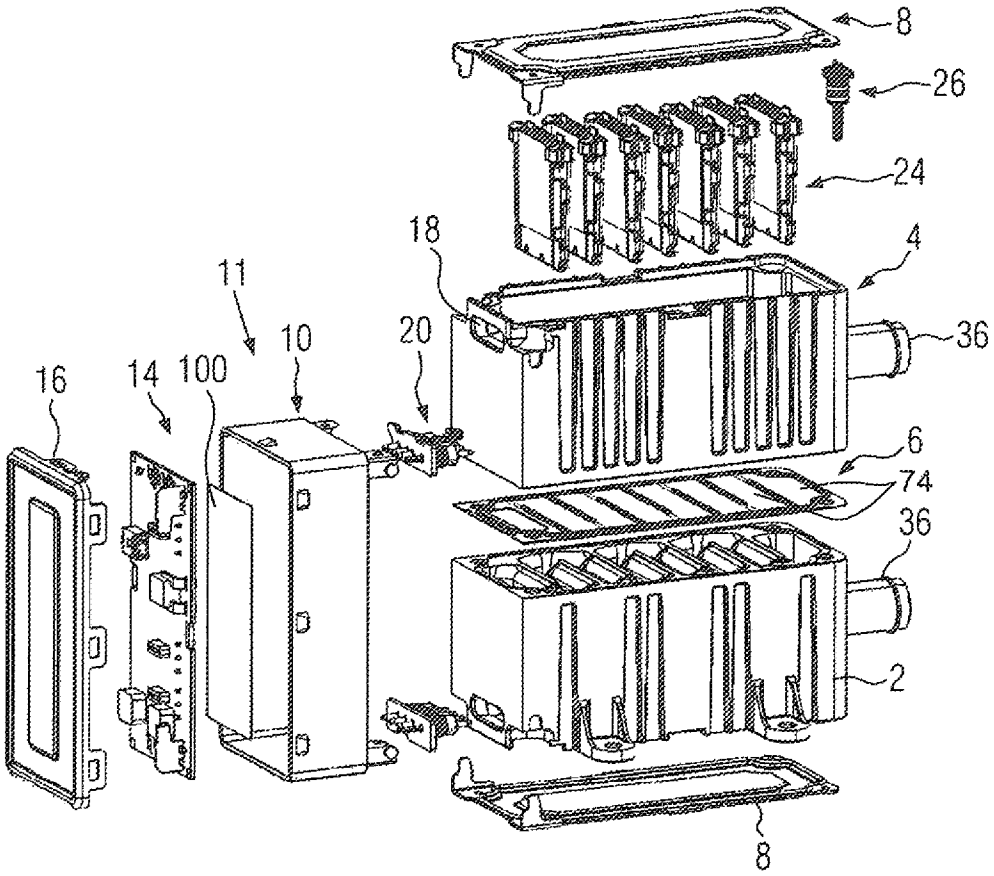
FIG. 1 an exploded drawing of a first embodiment.

FIG. 1 illustrates a perspective exploded drawing of a first embodiment of an electrical heating device. It comprises a first housing 2 and a second housing 4, formed essentially mirrored to it, which with the intermediate positioning of a covering element 6 are joined together, each being covered on the outside by a housing cover 8.

On a common face side of the two housings 2, 4 there is a control housing, identified with the reference numeral 10, of a control device 11, which has a control housing frame 12, which accommodates an assembled conductor board 14 and is closed by a control housing cover 16.

On their face sides facing the control housing 10, both housings 2, 4 have a housing connection opening 18 which is provided close to the housing cover 8. In this control housing connection opening 18 in each case a plug housing 20 can be inserted, which is manufactured from an insulating material, for example plastic, and bears a plurality of plug elements 22, which provide an electrical contact between electrical conductive paths provided in the two housings 2, 4 and the conductive paths of the assembled conductor board 14.

Furthermore, in FIG. 1 heater plate elements 24 are illustrated which are formed slightly wedge-shaped and correspond to those PTC heating elements which are disclosed in the European patent application EP 1 921 896 A1. The disclosure of this European patent publication is included by reference in the disclosed content of this patent application.

A temperature probe 26 is illustrated in front of the row of heater plate elements/PTC heating elements 24.

Figure 2:
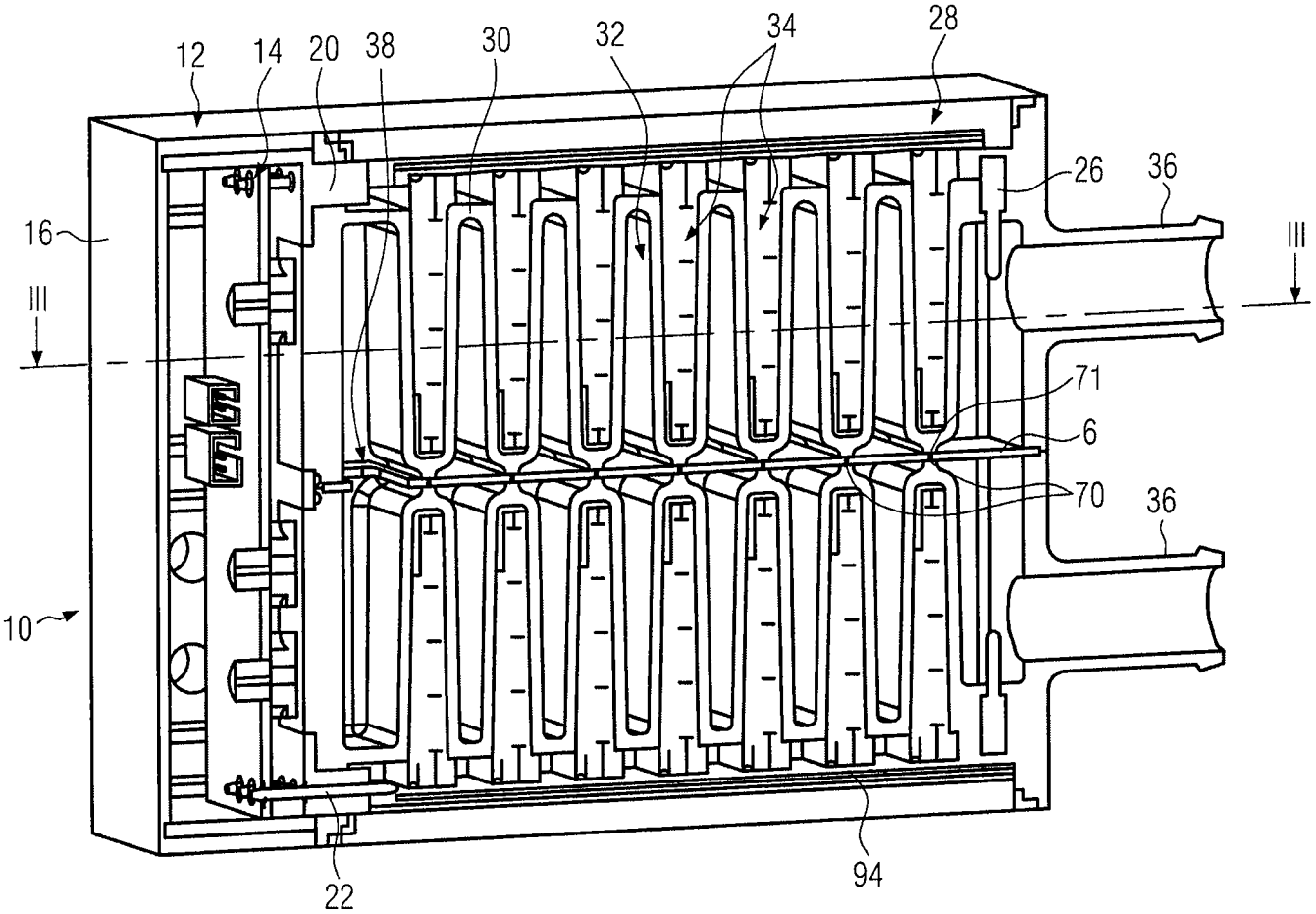
FIG. 2 a central longitudinal section through the embodiment illustrated in FIG. 1.

The installation of these elements into the housings 2, 4 can be particularly taken from FIG. 2. Accordingly, the housings 2, 4 each form two different chambers, namely a connecting chamber 28 and a circulation chamber separated from it by a partition wall 30. From the partition wall 30 in the circulation chamber 32 U-shaped recesses 34 protrude which extend deep into the circulation chamber 32 and terminate at the same height to the connecting chamber 28 as the partition wall 30. These recesses 34 are designed such that the heater plate elements 24 with a wedge surrounded by them can be used for heat conduction against the oppositely situated walls of the U-shaped recesses 34, as comprehensively described by the already mentioned EP 1 821 896 A1.

The circulation chamber 32 of each single housing 2, 4 extends between a connection piece 36 for the connection of a fluid hose and a flow passage aperture 38. Between these two outputs or end points of the circulation chamber 32 within it a meander-type flow channel 40 is formed within the housing 2 or 4, the course of which can be particularly taken from FIG. 3. The flow channel 40 has flow channel sections 42, which extend at right angles to the longitudinal extension of the housing 2 or 4 and are each bounded by outer walls of heating ribs 44 forming the U-shaped recesses 34. These heating ribs 44 are arranged alternately on oppositely situated inner sides 46 of the housings 2, 4. The housing 2 and the heating ribs 44 are here uniformly realised on an aluminium die-cast part. The heating ribs 44 are mounted on the oppositely situated inner sides 46 of the housing 2 or 4 via a ridge 48. This ridge 48 is less thick than the heating ribs 44. Thickness in this sense is taken to be the extent of the ridge in a direction at right angles to the flow channel sections 42, i.e. in the longitudinal direction of the housing 2. The exposed surfaces of the ridges 48, exposed to the flow channel 40, are formed concave, whereby a recess 50 is produced as part of the flow channel 40. In the flow channel 40 the flowing fluid to be heated can accordingly on one hand flow around the free ends 52 of the heating ribs 44, but on the other hand it can also in any case flow around a substantial part of the base end 54, so that the heating ribs 44 can dissipate heat to the fluid to be heated both via their oppositely situated longitudinal sides as well as via their face sides 52, 54. Here, a flow passage 56, which connects the relevant flow channel sections 42 together, is formed between the free ends 52 and the inner side 46 of the housing.

Figure 3:
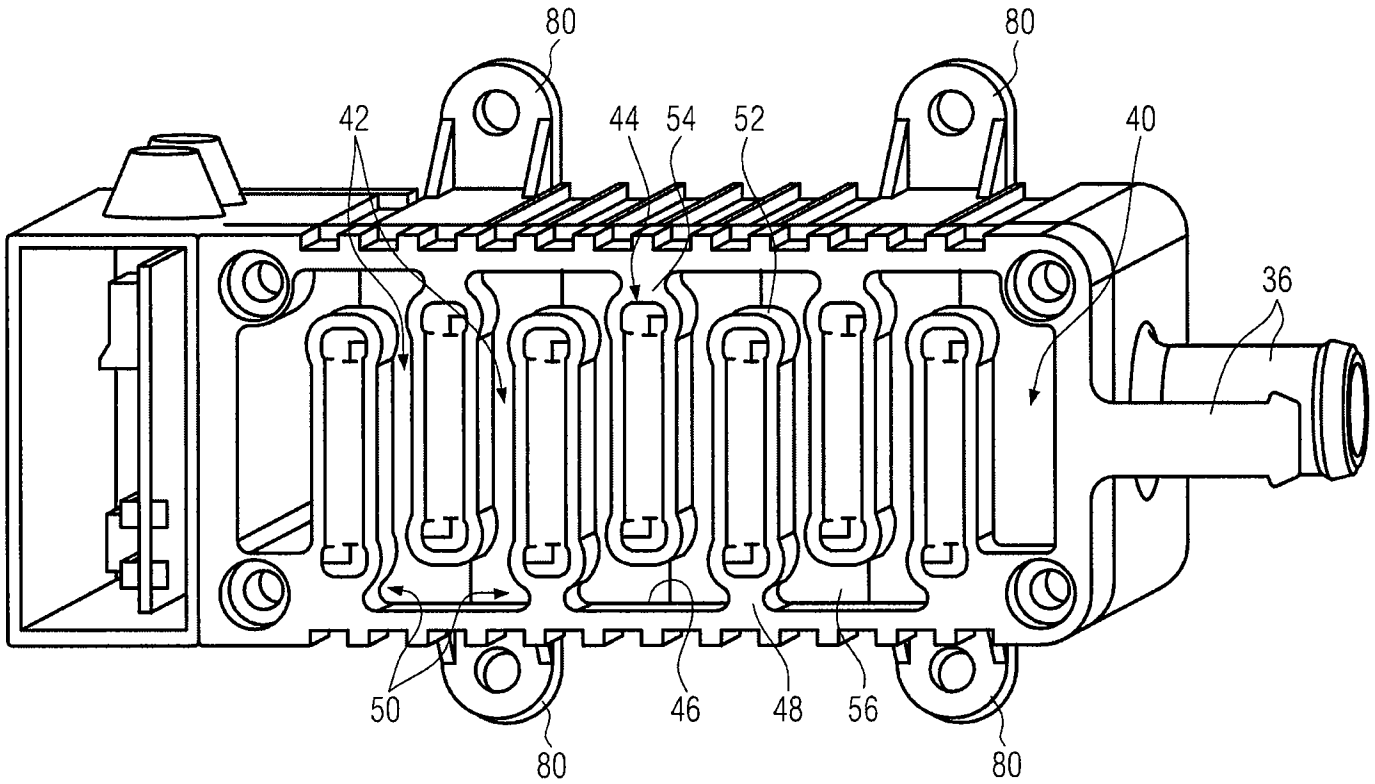
FIG. 3 a cross-sectional view along the line III-III according to the illustration in FIG. 2.

The housings 2 illustrated in FIGS. 1 to 3 are identically formed so that a flow path through two meander-type flow channels 40 is produced between the two connection pieces 36. The previously described temperature probes 26 are also provided double and namely directly in the region of the opening of the connection pieces 36. For this purpose temperature probe holes 60 are formed in the relevant housings 2, 4 in each case for the accommodation of a temperature probe 26 (cf. FIG. 4).

Figure 4:
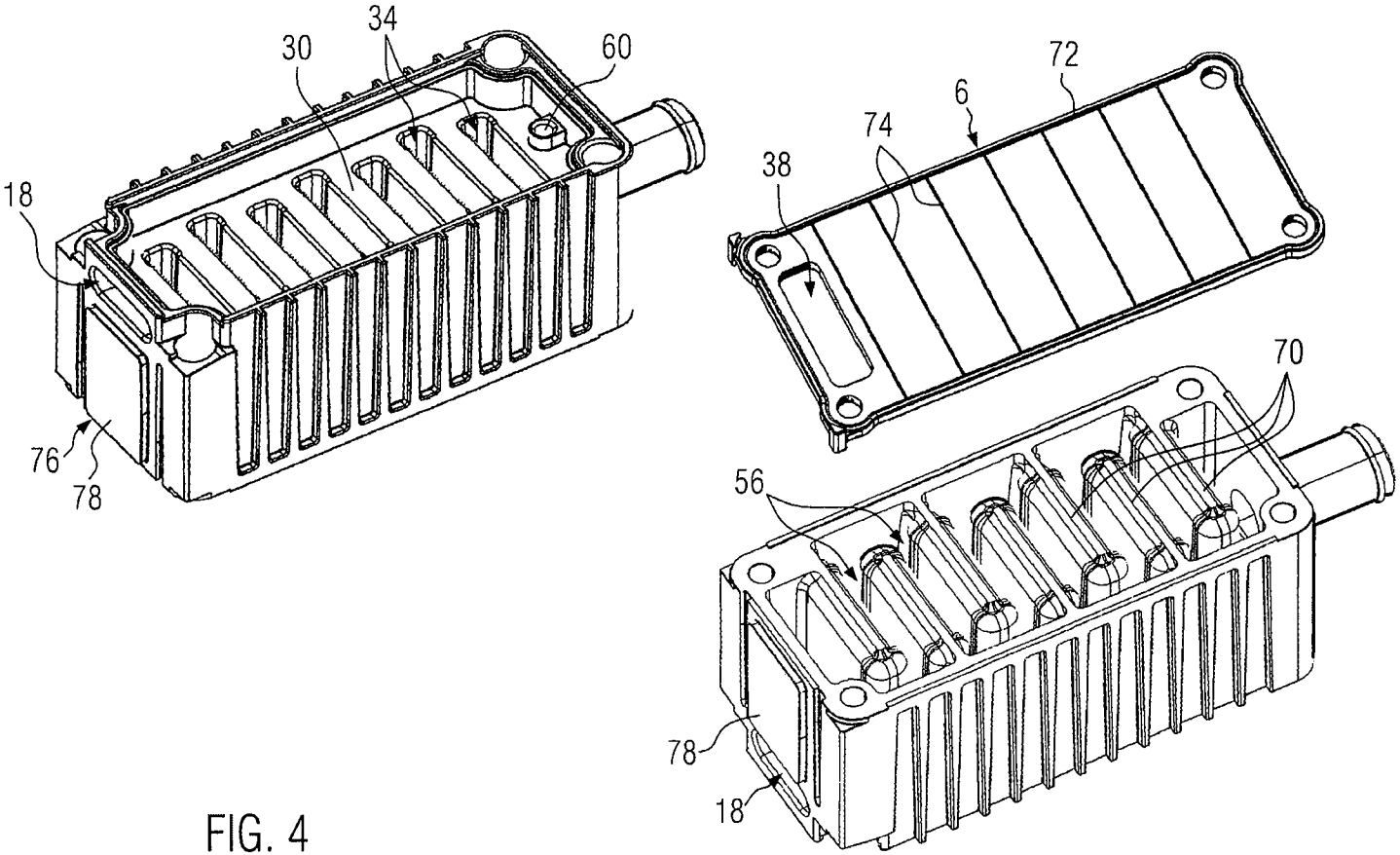
FIG. 4 perspective views of the two housings with the covering elements of the previously discussed embodiment provided in between them.

Furthermore, as can be seen from FIG. 4, tapered ridges 70 are formed on the underside of the heating ribs 44. All tapered ridges 70 terminate at the same height and form a support level for the covering element 6. Accordingly, the covering element between the tapered ridges 70 and the supporting counter ridges 71 of the oppositely situated housings 2, 4 is clamped for sealing.

The covering element 6 can for example be formed from a metal sheet, around which a flexible plastic is injection molded around, on one hand to form a circumferential sealing edge 72 and on the other hand however the sealing strips corresponding to the meander-type structure of the tapered ridges 70, which are illustrated in FIGS. 1 and 4, and which abut between the mutually oppositely situated, tapered ridges 70. The sealing edge 72 is clamped between the mutually oppositely situated face sides of the housings 2, 4.

On the face sides facing the control housing 10 the housings 2, 4 have a protrusion formed by milling, through which a cooling element 76 is formed in each case, which constitutes a cooling element contact base 78 extending parallel to the face side and the oppositely situated surface of which is exposed in the circulation chamber in the vicinity of the flow passage aperture 38 (cf. FIG. 4).

With the embodiment illustrated in FIGS. 1 to 4 the housing covers 8 are normally formed from punched metal. Also, they can bear a seal in an elastic plastic formed by injection molding around the housing covers 8. This applies correspondingly to the housing cover 16. Normally, the housing covers 8 in any case contact the housings 2, 4 through screws which also fix and seal the two housings 2, 4 together with the intermediate positioning of the covering element 6. The housings 2, 4 are formed identically. The feet 80 visible in FIGS. 1 and 3 can be separately manufactured and fastened retrospectively to the outer wall of the lower housing 2. The heating power of the electrical heating device can be increased in that a further package of two housings 2, 4 is positioned adjacent to that shown in FIGS. 1 to 4. The control of the individual heater plate elements 24 can be realised by a uniform controller with a uniform control housing.

Figure 5:
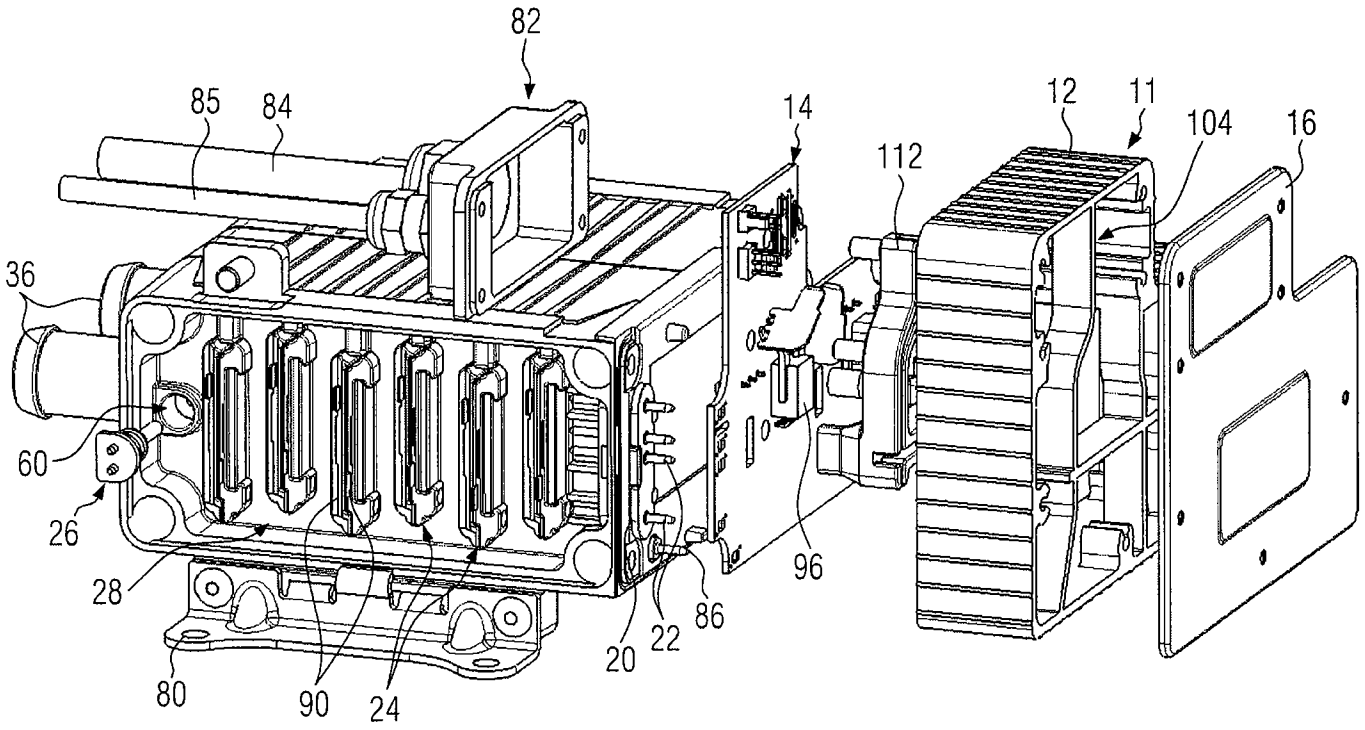
FIG. 5 an exploded drawing of a second embodiment.

FIGS. 5 to 11 illustrate a further embodiment of a heating device according to the invention. The same components are identified with the same reference numerals compared to the previously discussed embodiment. The construction of the housings 2, 4 of the circulation chambers 32 and the connecting chambers 28 is essentially identical to the previously discussed embodiment. However, the control housing 10 of the control device 11 extends sideward over the two housings 2, 4 for mounting a connecting housing 82, which bears an electrical cable 84 for the power current and an electrical cable 85 for the control signals and leads in a sealed manner into the interior of the connecting housing 82. In the region of the connection pieces 36 a contact element 86, contacting the housings 2, 4 electrically, is provided in each case, which facilitates a check of the polarity of the two housings 2, 4 in order to detect any fault in the electrical isolation of the housing 2 or 4 from the current-carrying paths. FIG. 5 illustrates in any case the connecting end of this further contact element 86.

Figure 6:
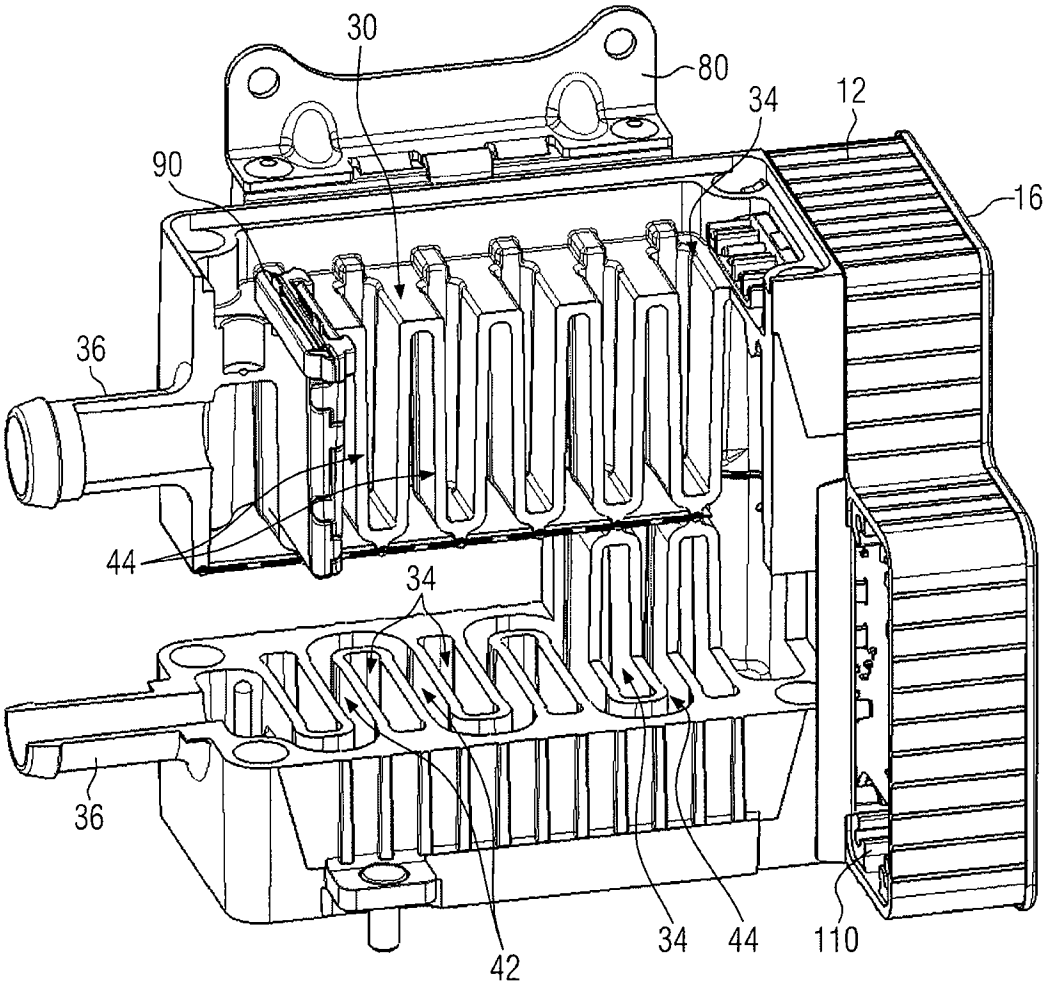
FIG. 6 a partially cut-away perspective side view of the second embodiment.

The parts of the embodiment omitted in FIG. 6 clearly show the flow path within the housings 2, 4 as well as the embodiment of the heating ribs 44 and of the U-shaped recesses 34 formed in them.

As can also be seen from FIG. 6, the heater plate elements 24 have a widened collar 88, which rests on the upper side of the partition wall 30, so that the heater plate elements 24 protrude into the U-shaped recesses 34 with a certain depth. This collar 88 has contact lugs 90 of the heater plate elements 24 protruding over it. These contact lugs 90 are freely cut ends of electrically conducting sheet metal plates, which contact PTC blocks 92 on both sides, can supply current to them with different polarity and are graphically illustrated in FIG. 7 and are identified with the reference numeral 93. Four PTC blocks 92 are enveloped one above the other by each heater plate element 24. As can also be taken from FIG. 7, the contact lugs 90 are exposed at the same level within the connecting chamber 28. At this level the connecting end of the temperature probe 26 is exposed.

Figure 7:
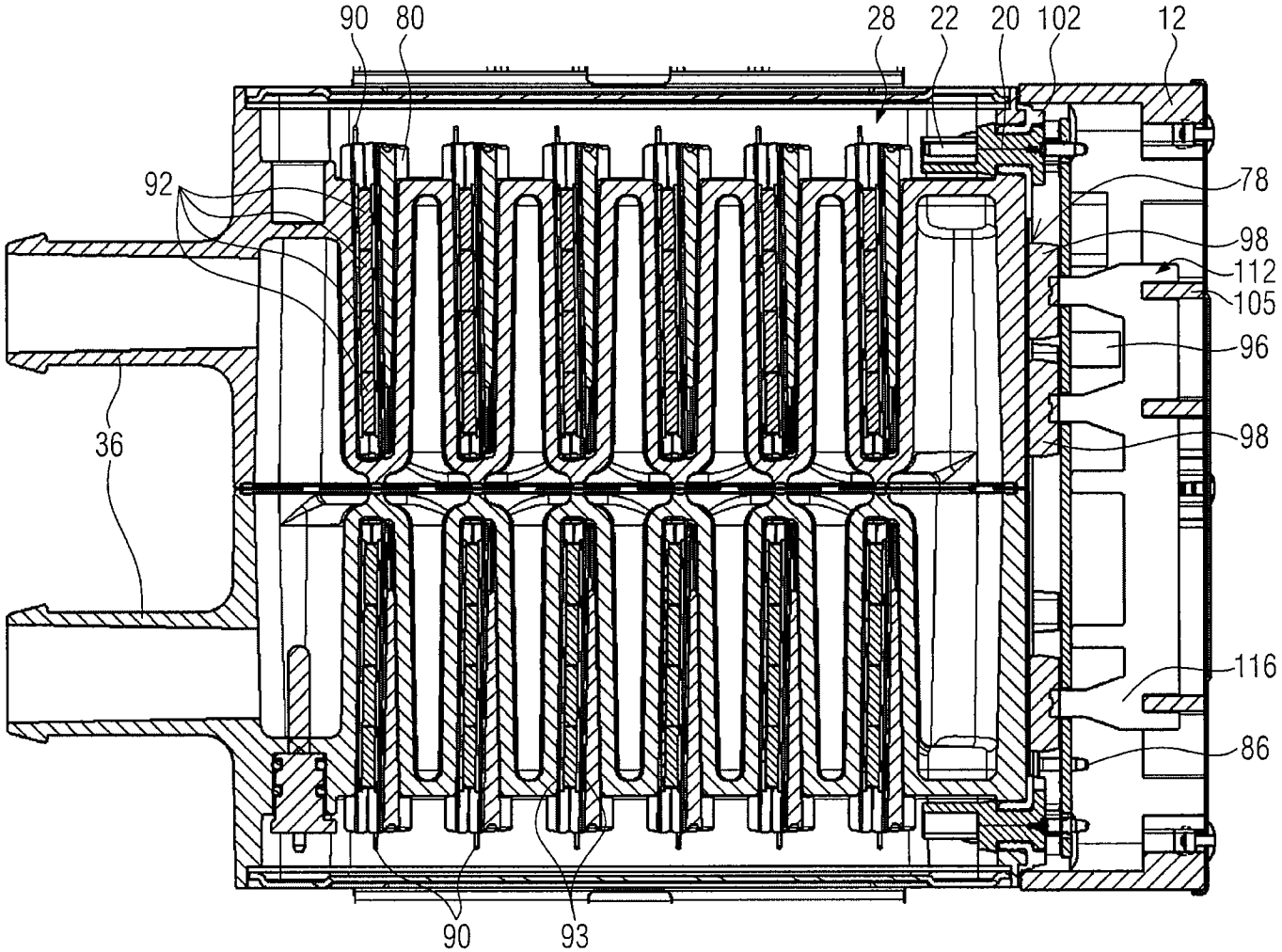
FIG. 7 a longitudinal sectional view of the second embodiment.
Figure 8:
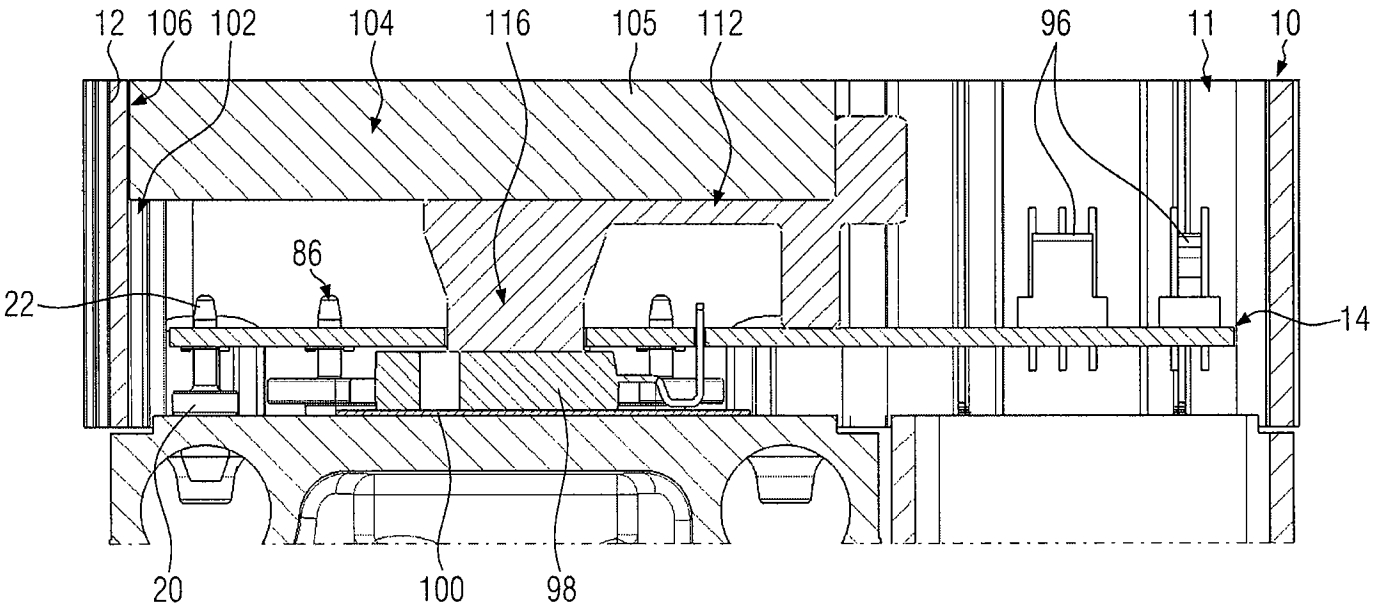
FIG. 8 an enlarged longitudinal sectional view of the control housing of the second embodiment.

In the connecting chamber 28 there is a connecting conductor board, the representation of which is omitted in FIG. 7, but which is identified with the reference numeral 94 in FIG. 2. The connecting conductor board 94 extends essentially parallel to the partition wall 30 and rests on the collar 88. It forms electrical connecting elements for the accommodation of the individual contact lugs 90 and a contact receptacle for the connecting end of the temperature probe 26. On the face side oppositely situated to the temperature probe 26 the connecting conductor board 94 has electrical connecting recesses for contacting the plug elements 22 exposed in the connecting chamber 28. The connecting conductor board 94 and the electrical connecting elements of it are here embodied such that all electrical connections to the connecting conductor board 94 are realised when the connecting conductor board 94 is placed on the collars 88. Thus the electrical plug contacts in the connecting chamber 28 are electrically connected to the plug elements 22.

In the following the construction of the control device 11 is described, particularly with reference to the FIGS. 7 to 11. On its surface facing away from the housings 2, 4 the assembled conductor board 14 bears various electrical or electronic components 96. On the oppositely situated underside of the assembled conductor board 14, facing the housings 2, 4, components and control elements 98 producing a power loss, in particular power transistors, are provided. Between these power transistors 98 and the cooling element contact base 78 there is an electrical insulating layer 100. This insulating layer 100 is located in a recess of a control housing base 102 of a flexible material, in particular in a flexible plastic, which is clamped between the face side of the control housing frame 12 facing the housing 2 or 4 and the face side of the housing 2, 4. This control housing base 102 has receptacles into which the plug housings 20 are introduced. The plug housings 20 have flanges which grasp the control housing base 102 on the uppersides and undersides (cf. FIGS. 7, 9). The control housing base 102 protrudes sleeve-like into the control housing connection openings 18, whereby secure mounting and sealing of the plug housings 20 is realised (cf. FIG. 7). The inside of the control housing 10 is accordingly sealed with respect to the connecting chamber 28.

Figure 9:
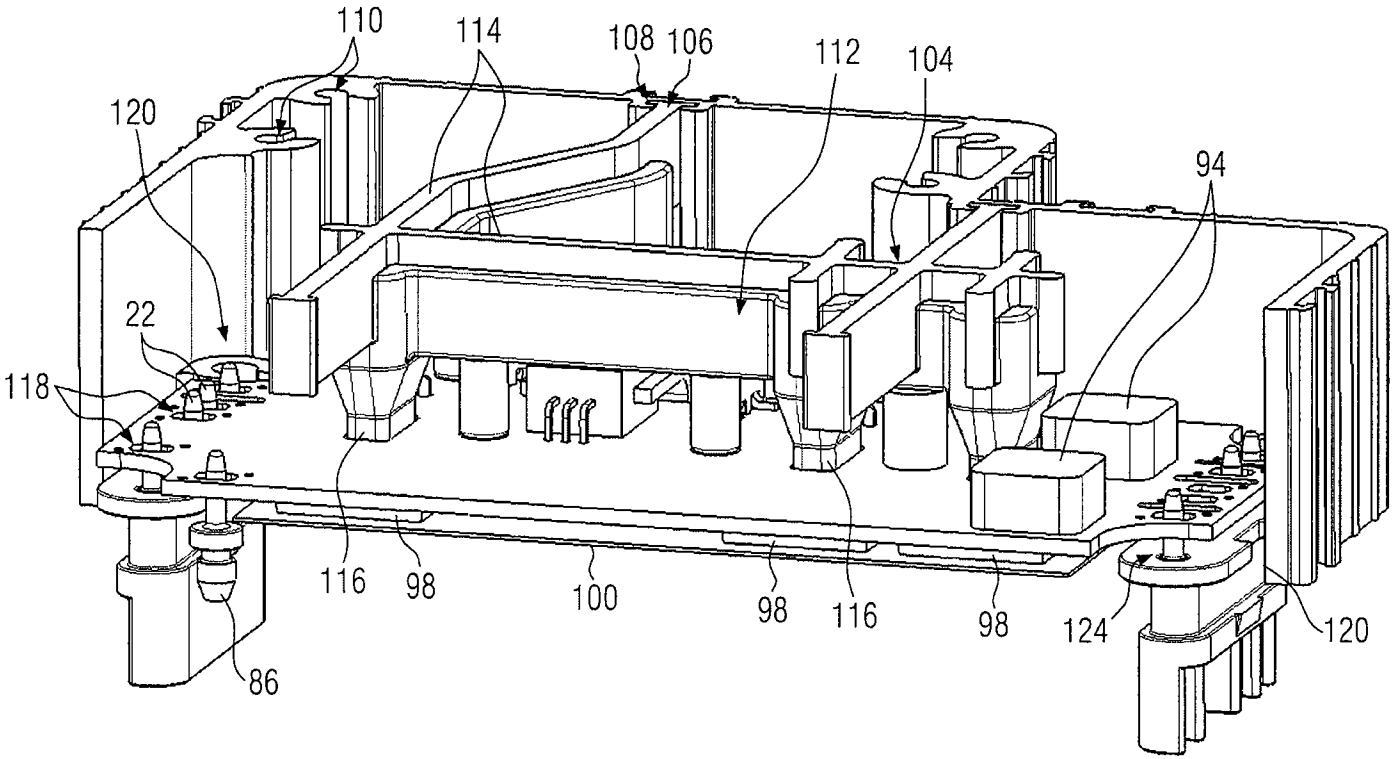
FIG. 9 a partially cut-away perspective side view of the control housing of the second embodiment.
Figure 10:
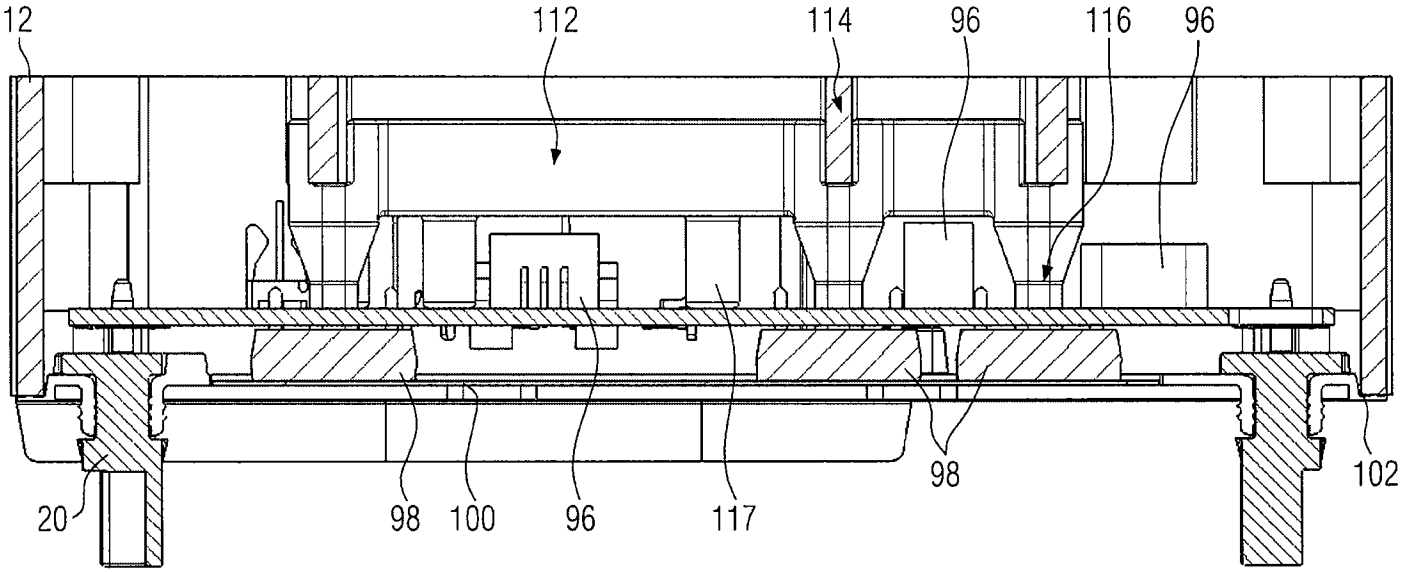
FIG. 10 a longitudinal sectional view of the control housing of the second embodiment.
Figure 11:
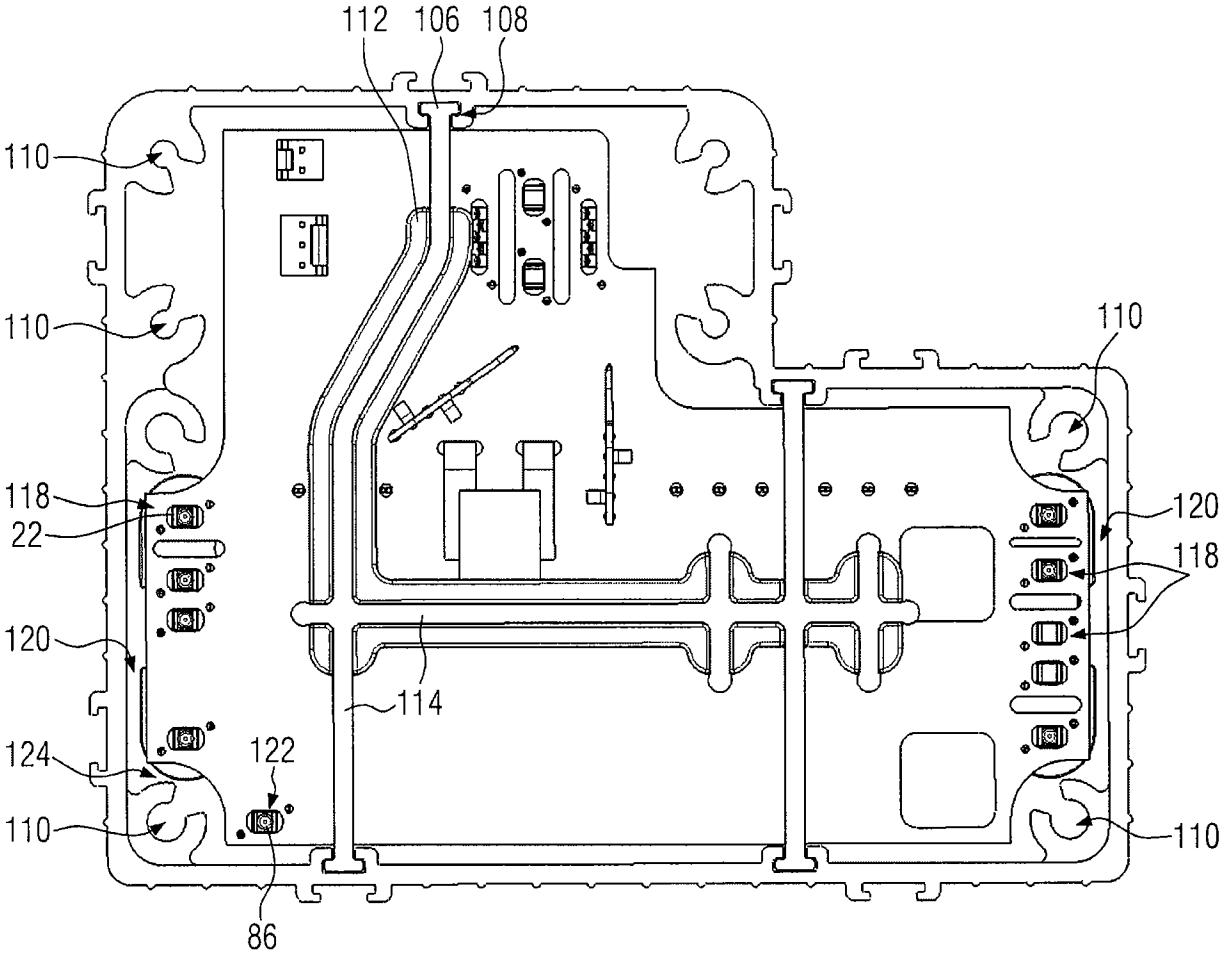
FIG. 11 a plan view of the control housing of the second embodiment.

As can be seen, particularly from FIGS. 9 and 11, a supporting framework structure 104, which is manufactured as a separate component, formed from thin ridges 105 forming the supporting framework structure 104, is located within the control housing frame 12. The ends of the ridges 105 are enlarged to a hammer head 106 in the vicinity of the control housing frame 12. The hammer head 106 is held in accommodating slots 108, which are formed on the inner wall of the control housing frame 12 by the control housing frame.

Also in the corner regions mounting protrusions in the form of mounting eyes 110, the longitudinal extension of which corresponds to the height of the control housing frame 12, are formed on the control housing frame 12. These eyes are not circumferentially closed, but rather have an open slit towards the inside of the control housing frame 12. The mounting eyes 110 are used for holding the threaded rods which join the control housing frame 12 to the housings 2, 4 with the inclusion of the control housing cover 16. They are also used however to accommodate threaded rods, which fasten the connecting housing 82 to the control housing frame 12.

Between the supporting framework structure 104 and the assembled conductor board 14 a compression element identified with the reference numeral 112 is provided in a flexible plastic. On its face side facing the supporting framework structure 104 this compression element 112 forms U-shaped recesses for the ridges 105 of the supporting framework structure 104, so that the compression element 112 is held positively locked on the supporting framework structure 104. The compression element 112 is similarly formed lattice-like, whereby lattice ridges 114 of the compression element 112 have pillar supports 116 of the compression element 112 extending over them, the said supports engaging corresponding recesses formed on the assembled circuit board 14 for this purpose and directly contacting the control components 98 producing the power loss. The pillar supports 116 are provided there where the control components 98 producing the power loss are arranged on the side of the assembled conductor board 14 oppositely situated with respect to the pillar supports 116. One or a plurality of retaining clamps 117, which act on the conductor board 14, protrude from the compression element 112 and/or the lattice ridges 114.

As can be seen from FIG. 11, the assembled conductor board 14 also has contact element receptacles 118, which are formed on oppositely situated marginal regions 120 of the assembled conductor board 14. The contact element receptacles 118 are formed as elongated holes. Also a further contact lug receptacle 122 for the contact element 86 is formed as an elongated hole. All elongated holes have longitudinal axes which are mutually parallel. Plug counter elements 119 are arranged in the contact element receptacles 118. The assembled conductor board 14 is fixed with a slight play within the control housing frame 12. In the corner regions of the assembled conductor board 14 cut-outs 124 are provided, whereby the mounting eyes 110 pass right through the plane of the assembled conductor board 14.

For assembly normally the control device 11 is first pre-assembled, i.e. the assembled conductor board 14 is arranged within the control housing frame 12. The plug housings 20 are inserted through the cut-outs in the control housing base 102 and thus connected. Then the pre-assembled control device 10 is pushed onto the housings 2, 4 with the intermediate positioning of the insulating layer 100. Here, the plug housings 20 are introduced for sealing into the housing connection openings 18. Due to the embodiment of the contact receptacles 118 as elongated holes, the plug elements 22 can in this respect perform a certain compensating movement without the electrical contact between these plug elements 22 and the plug counter elements 119 of the assembled conductor board 14 being lost. Then the control housing frame 12 together with the control housing cover 16 is screwed to the housings 2, 4. Here, first the surfaces of the control components 98 producing the power loss rest on the cooling element contact bases 78. After the assembly of the control housing 10 on the housings 2, 4 the control components 98 producing the power loss abut the cooling elements 76 at the housing end under prestress and are thus connected reliably for thermal conduction. Within the scope of this assembly the pillar supports 116 of the compression elements 112 are in particular elastically compressed, whereby an elastic prestress is stored in the compression element 112.

Figure 12:
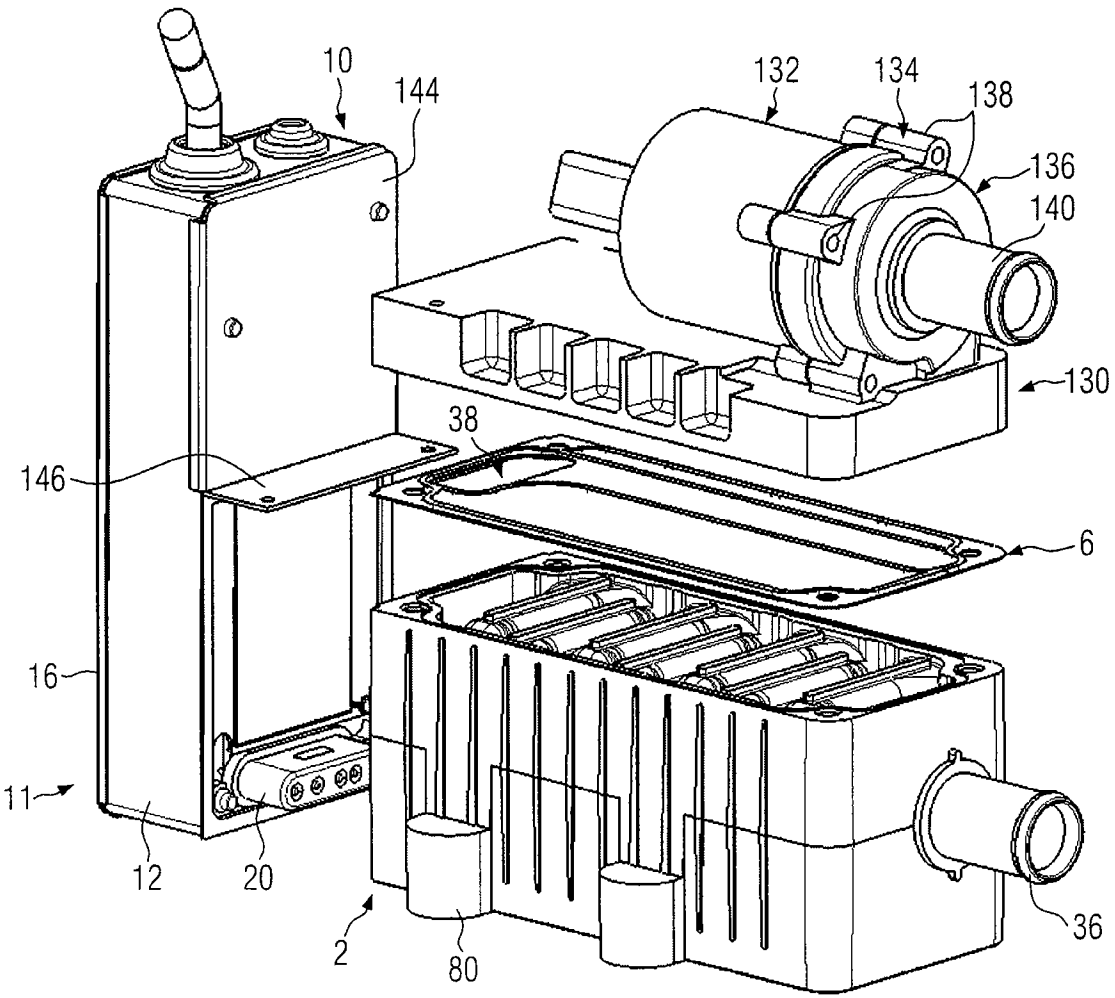
FIG. 12 an exploded drawing of a third embodiment.
Figure 13:
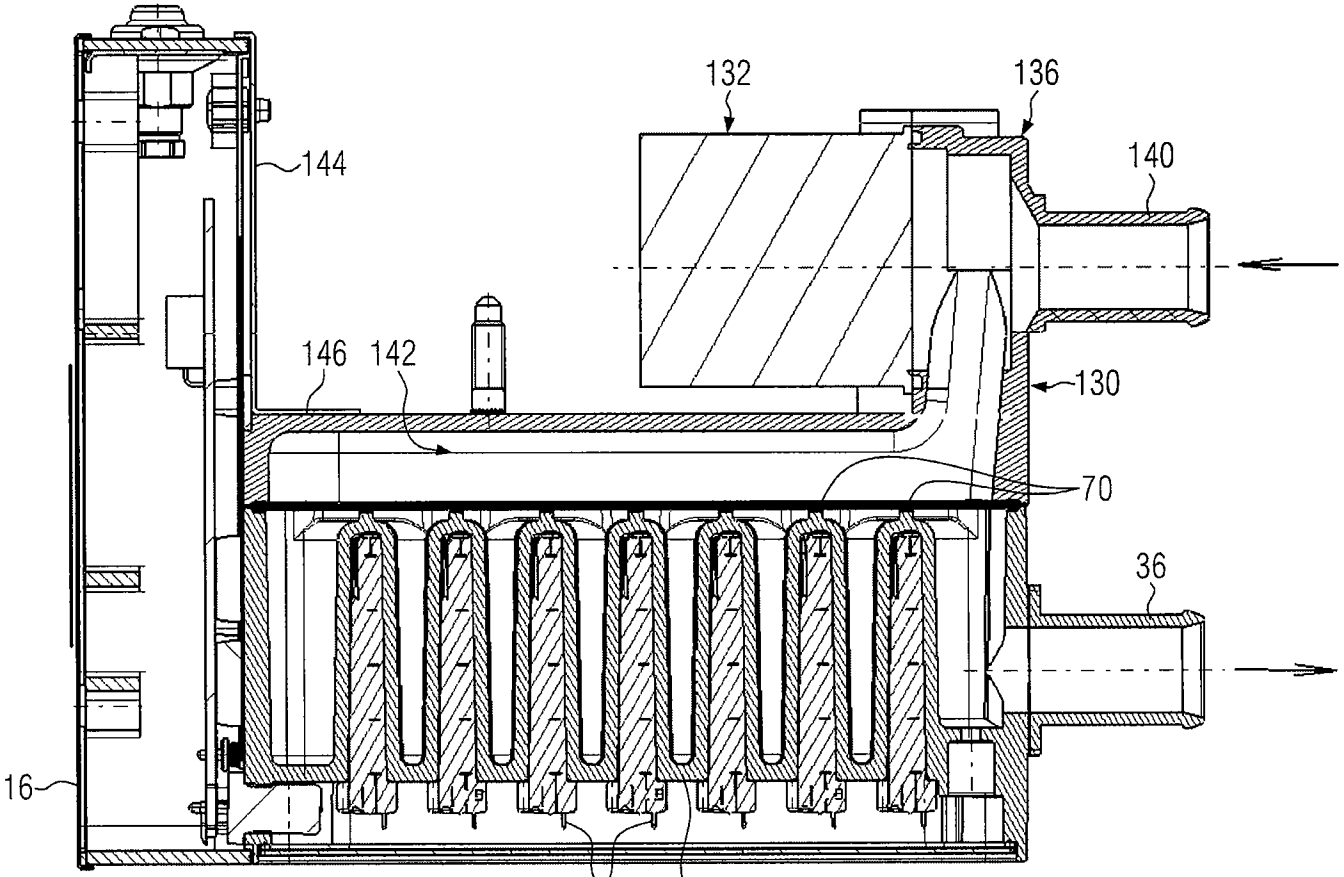
FIG. 13 a longitudinal sectional view of the third embodiment.

FIGS. 12 and 13 illustrate a further embodiment of an electrical heating device according to the invention. The same components are identified with the same reference numerals compared to the previously discussed embodiment.

The embodiment according to FIGS. 12 and 13 has only one housing 2, which is provided with a covering element 6 for forming the circulation chamber 32 between the covering element 6 and the partition wall 30. The embodiment also has a housing cover 130 which bears a pump 132 and in any case partially forms a pump housing 134. Here, the housing cover 130 forms a flow inlet housing part 136 which forms attachment elements 138 for flange-connecting the pump 132 and a hose connection piece 140. The covering element 6 only has sealing strips 74 suitable to the structure of the tapered ridges 70 on its underside facing the housing 2. On the oppositely situated upper side, sealing strips 74 are provided running on the covering element 6 suitable for a pump channel 142 formed by the housing cover 130. This pump channel 142 connects the flow passage aperture 38 to the flow inlet housing part 136.

The control housing frame 12 is formed identically to the embodiment discussed with reference to FIGS. 1 to 4. However the control housing frame is partially closed by a control housing base cover 144 which forms a bent flange 146 which is screwed onto the upper side of the control housing cover 130.

The power supply and the control connection of the pump 132 preferably occurs similarly via the assembled conductor board 12. With the embodiment illustrated in FIGS. 12 and 13 this occurs via a cable which connects the control device 11 to the pump 132. With the embodiment illustrated in FIGS. 12 and 13 the cable (not illustrated) extends from a lateral face of the control housing frame 12 to the pump 32. Just as well however, a plug housing 20 can be provided at the level of the pump 132 through which the electrical connection of the pump 132 occurs.

Figure 14:
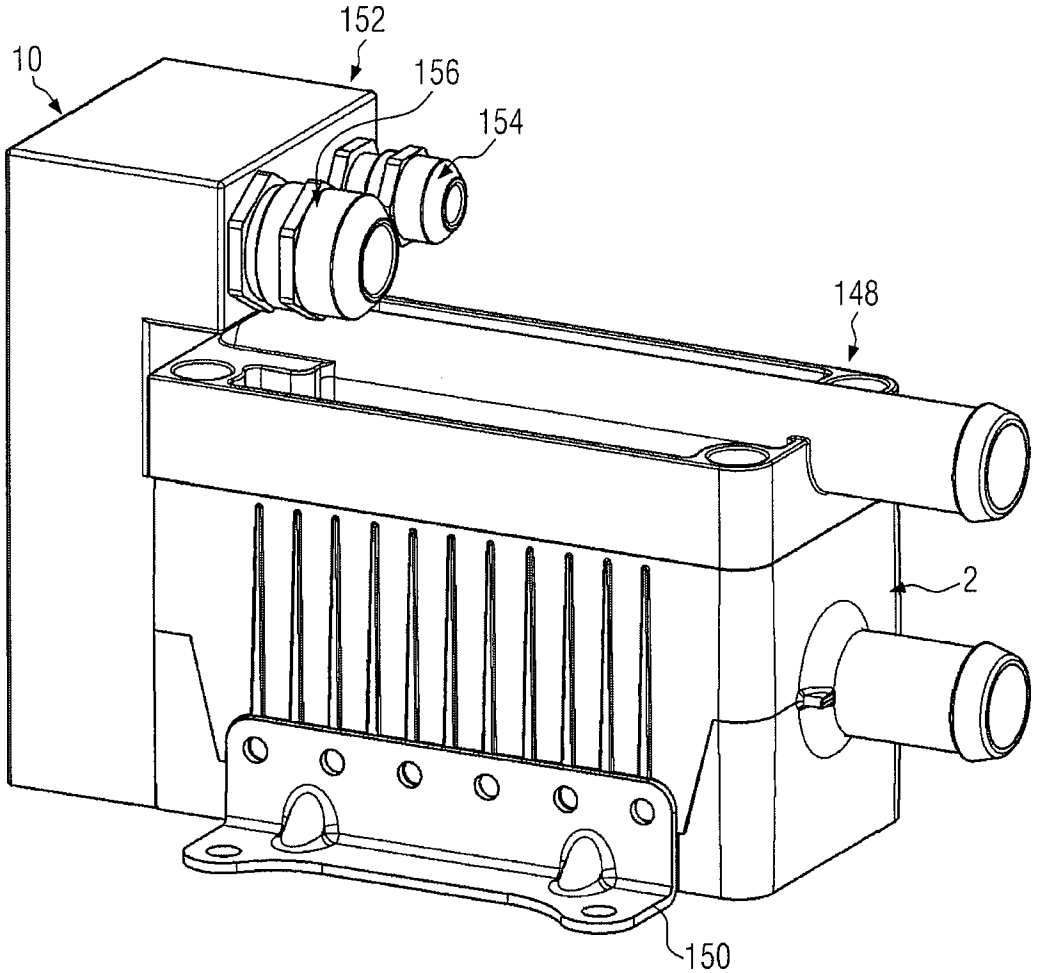
FIG. 14 a perspective side view of a fourth embodiment.
Figure 15:
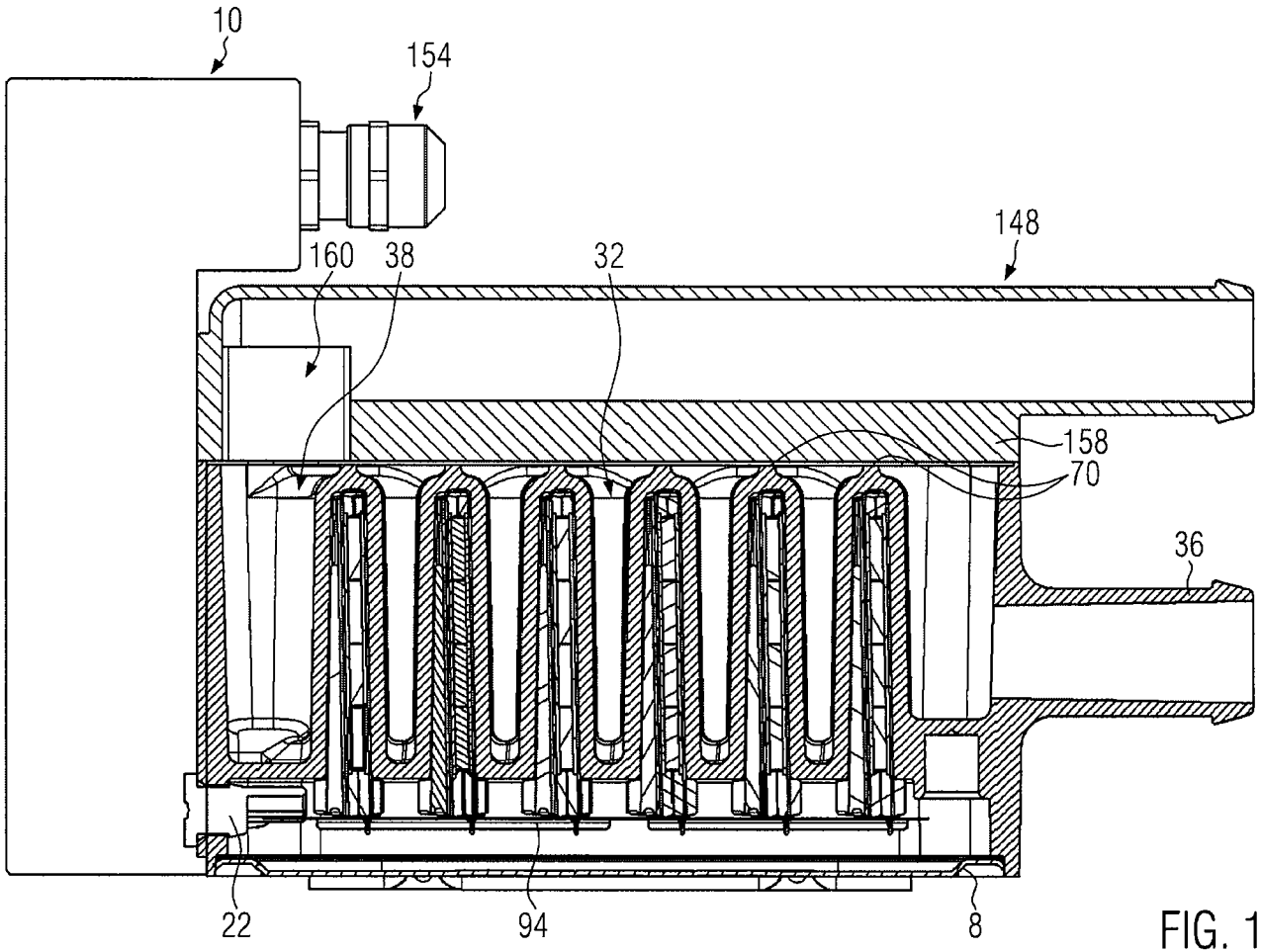
FIG. 15 a longitudinal sectional view of the fourth embodiment illustrated in FIG. 14.

FIGS. 14 and 15 illustrate a fourth embodiment. The same components are identified with the same reference numerals compared to the previously discussed embodiment.

As the previously described embodiments, the fourth embodiment comprises a housing 2 which is joined to a housing cover 148 and mounting flanges 150 for mounting the electrical heating device are fitted to its longitudinal sides. On a face side of the housing 2 and the housing cover 148 there is the control housing 10 with the controller which is accommodated in it and which is not detailed in FIGS. 14 and 15. This control housing 10 is in the present case formed L-shaped with an overhang 152 protruding slightly over the housing cover 148, with two cable clamps 154, 156 mounted on its face sides for mounting and sealing cables secure against twisting and strain. The cable clamp 154 is used for connecting a connecting cable; the larger cable clamp 156 is used for connecting a cable for the power current. The housing 2 is formed identically to the previously described housings 2. In this respect reference is made to the above description.

The housing cover 148 has a bottom plate 158 positioned on the housing 2, with the said bottom plate interacting with the edge of the housing 2 and the tapered ridge 10 with the inclusion of the covering element 6, whereby the circulation chamber 32 is sealed in the region of the tapered ridges 70. In the flow direction behind the flow passage aperture 38, the housing cover 148 forms a flow passage 160 which communicates with a tube 162 formed as one part on the housing cover 148, which extends parallel to the connection piece 136 and terminates with it essentially at the same level.

The embodiment illustrated in FIGS. 14 and 15 is relatively small and has a thermal output of not more than 3 kW, and normally a thermal output of between 1.5 and 2.8 kW. The embodiment is suitable for example for battery preheating in electric vehicles.

What is claimed is:

1. A method of producing an electrical heating device for a motor vehicle, the electrical heating device including:

a housing enclosing a circulation chamber through which a medium can flow, heating ribs protruding in the circulation chamber, the heating ribs being in thermally conducting contact with at least one Positive Temperature Coefficient ("PTC") heating element, the housing enclosing the circulation chamber also providing a cooling element;

a control device in a constructional unit with at least one assembled conductor board, and a control housing accommodating the control device, wherein the control device bears a control element that produces a power loss, the control element being arranged at an underside of the assembled conductor board;

the method comprising:

mounting the control housing on the housing enclosing the circulation chamber, so that the control element that produces the power loss arranged at the underside of the assembled conductor board is facing the housing enclosing the circulation chamber and so that the control element is laid against the cooling element under prestress.

2. The method as defined in claim 1, wherein the prestress is stored in a compressible compression element which causes a compression force to act against the assembled conductor board.

3. The method as defined in claim 2, wherein the compression element forms a pillar support extending essentially at right angles to the surface of the assembled conductor board, and wherein the pillar support is positioned such that the compression force imparted by the pillar support presses the control element that produces the power loss against the cooling element.

4. The method as defined in claim 3, wherein the pillar support is positioned to abut against the assembled conductor board on at least one of the side situated opposite the control element that produces the power loss and the control element that produces the power loss.

5. The method as defined in claim 1, wherein a control housing frame is provided that is formed from a metallic material and a supporting framework structure is provided as an element separate from the control housing frame, and wherein the assembled conductor board is placed within the control housing frame such that the control housing frame circumferentially surrounds the assembled conductor board and such that the control housing frame and the supporting framework structure are joined.

6. The method according to claim 5, wherein the assembled conductor board is positioned with slight play between inner surfaces of the control housing frame.

7. The method according to claim 5, wherein the control housing frame is made as an aluminium extruded section.

8. The method according to claim 1, wherein the control element that produces the power loss is positioned to abut the cooling element with an electrical insulating layer being positioned therebetween.

9. A method of producing an electrical heating device for a motor vehicle, wherein the electrical heating device includes a housing having a cooling element, the housing enclosing a circulation chamber through which a medium can flow, heating ribs protruding from the housing, at least one Positive Temperature Coefficient ("PTC") heating element in thermal contact with the heating ribs, a control device and an assembled conductor board provided in the housing in a constructional unit with one another, a control element that produces a power loss and that is borne by the housing, the control element being arranged at an underside of the assembled conductor board, and a control housing accommodating the housing having the cooling element, wherein the method comprises:

mounting the control housing on the housing having the cooling element so that the control element that produces the power loss arranged at the underside of the assembled conductor board is facing the housing having the cooling element and is laid against the cooling element under prestress.

10. A method of producing an electrical heating device for a motor vehicle, wherein the electrical heating device includes a housing enclosing a circulation chamber through which a medium can flow, heating ribs protruding in the circulation chamber, the heating ribs being in thermally conducting contact with at least one Positive Temperature Coefficient ("PTC") heating element, the housing enclosing the circulation chamber also providing a cooling element; and a control device in a constructional unit with at least one assembled conductor board, and a control housing accommodating the control device, wherein the control device bears a control element that produces a power loss, the control element being arranged at an underside of the assembled conductor board;

the method comprising:

mounting the control housing on the housing enclosing the circulation chamber such that the control element producing the power loss arranged at the underside of the assembled conductor board is facing the housing enclosing the circulation chamber and so that the control element is laid against the cooling element under prestress, wherein prestress is stored in a compressible compression element which causes a compression force to act against the assembled conductor board, wherein a control housing frame is provided that is formed from a metallic material and a supporting framework structure is provided as an element separate from the control housing frame, wherein the assembled conductor board is placed within the control housing frame such that the control housing frame circumferentially surrounds the assembled conductor board and such that the control housing frame and the supporting framework structure are joined, and wherein the compression element forms a pillar support extending essentially at right angles to the surface of the assembled conductor board, and wherein the pillar support is positioned such that the compression force imparted by the pillar support presses the control element producing the power loss against the cooling element.

11. The method as defined in claim 10, wherein the pillar support is positioned to abut against the assembled conductor board on at least one of the side situated opposite the control element producing the power loss and the control element producing the power loss.

12. The method according to claim 10, wherein the control element producing the power loss is positioned to abut the cooling element with an electrical insulating layer being positioned therebetween.

13. The method according to claim 10, wherein the assembled conductor board is positioned with slight play between inner surfaces of the control housing frame.

14. The method according to claim 10, wherein the control housing frame is made as an aluminium extruded section.

* * * * *